US010607544B2

(12) United States Patent
Lee et al.

(10) Patent No.: US 10,607,544 B2
(45) Date of Patent: Mar. 31, 2020

(54) ORGANIC LIGHT-EMITTING DISPLAY PANEL, ORGANIC LIGHT-EMITTING DISPLAY DEVICE, DATA DRIVER, AND LOW POWER DRIVING METHOD

(71) Applicant: LG DISPLAY CO., LTD., Seoul (KR)

(72) Inventors: BuYeol Lee, Goyang-si (KR); YoungJoon Lee, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 15/689,681

(22) Filed: Aug. 29, 2017

(65) Prior Publication Data

US 2018/0090073 A1 Mar. 29, 2018

(30) Foreign Application Priority Data

Sep. 23, 2016 (KR) ..... 10-2016-0122424

(51) Int. Cl.

| | |
|---|---|
| ***G09G 3/30*** | (2006.01) |
| ***G09G 3/3258*** | (2016.01) |
| ***G09G 3/3233*** | (2016.01) |
| *G09G 3/3275* | (2016.01) |

(52) U.S. Cl.

CPC ..... *G09G 3/3258* (2013.01); *G09G 3/3233* (2013.01); *G09G 3/3275* (2013.01); *G09G 2300/0439* (2013.01); *G09G 2300/0842* (2013.01); *G09G 2310/0264* (2013.01); *G09G 2330/022* (2013.01); *G09G 2340/0435* (2013.01)

(58) Field of Classification Search

CPC .. G09G 3/3225; G09G 3/3233; G09G 3/3258; G09G 3/3275

USPC ..... 345/76

See application file for complete search history.

(56) References Cited

U.S. PATENT DOCUMENTS 5,996,082 A 11/1999 Cortopassi
2008/0225062 A1* 9/2008 Chang ..... G09G 3/3208 345/691

(Continued)

FOREIGN PATENT DOCUMENTS

CN 101533611 A 9/2009
CN 102930831 A 2/2013

(Continued)

*Primary Examiner* — Adam J Snyder

(74) *Attorney, Agent, or Firm* — Birch, Stewart, Kolasch & Birch, LLP

(57) ABSTRACT

An organic light-emitting display device includes an organic light-emitting display panel having a plurality of subpixels connected to data lines and gate lines; a data driver driving the data lines; and a gate driver driving the gate lines, wherein the organic light-emitting display device has a first mode having a first refresh rate and a second mode having a second refresh rate that is lower than the first refresh rate, the second mode having a first period and a second period that is subsequent to the first period, and wherein, in the first period of the second mode, the data driver subsequently supplied data voltages to at least two of the plurality of subpixels, and in the second period of the second mode, the data driver supplies a specific voltage to the plurality of subpixels, the specific voltage being the same as one of at least two of the data voltages sequentially supplied to the at least two subpixels.

20 Claims, 16 Drawing Sheets

(56) References Cited

U.S. PATENT DOCUMENTS

| | | | | |
|---|---|---|---|---|
| 2011/0084958 | A1* | 4/2011 | Choi | G09G 3/3233 345/213 |
| 2011/0234564 | A1* | 9/2011 | Kim | G09G 3/3655 345/211 |
| 2012/0069059 | A1* | 3/2012 | Lee | G09G 3/3225 345/690 |
| 2013/0265294 | A1* | 10/2013 | Kim | G09G 3/20 345/214 |
| 2014/0104298 | A1* | 4/2014 | Park | G09G 5/10 345/589 |
| 2016/0012774 | A1 | 1/2016 | Ohara et al. | |
| 2016/0098959 | A1* | 4/2016 | Moon | G09G 3/2092 345/205 |
| 2016/0124491 | A1* | 5/2016 | An | G06F 1/3265 713/323 |
| 2016/0210900 | A1* | 7/2016 | Kim | G09G 3/3233 |
| 2016/0351103 | A1* | 12/2016 | Park | G09G 3/2007 |
| 2017/0053592 | A1* | 2/2017 | Shin | G06F 3/011 |
| 2017/0116922 | A1* | 4/2017 | Jung | G09G 3/3258 |
| 2017/0140700 | A1* | 5/2017 | Yamamoto | G09G 3/30 |

FOREIGN PATENT DOCUMENTS

| | | | |
|---|---|---|---|
| CN | 103299359 | A | 9/2013 |
| CN | 104247407 | A | 12/2014 |
| CN | 104978064 | A | 10/2015 |
| EP | 2 154 922 | B1 | 9/2014 |
| EP | 2435179 | B1 | 2/2017 |
| JP | 2004-163777 | A | 6/2004 |
| JP | 2014-522506 | A | 9/2014 |
| WO | WO 2012/164474 | A2 | 12/2012 |

* cited by examiner

ORGANIC LIGHT-EMITTING DISPLAY PANEL, ORGANIC LIGHT-EMITTING DISPLAY DEVICE, DATA DRIVER, AND LOW POWER DRIVING METHOD

CROSS REFERENCE TO RELATED APPLICATION

This application claims priority from Korean Patent Application No. 10-2016-0122424 filed on Sep. 23, 2016, which is hereby incorporated by reference for all purposes as if fully set forth herein.

BACKGROUND OF THE INVENTION

Field of the Invention

The present disclosure relates to an organic light-emitting display panel, an organic light-emitting display device, a data driver, and a low power driving method.

Description of Related Art

Organic light-emitting devices, devices which have come to prominence as next generation display devices, have inherent merits, such as high response rates, high luminous efficiency, high levels of luminance, and wide viewing angles, since organic light-emitting diodes (OLEDs) able to emit light by themselves are used therein.

In organic light-emitting display devices, subpixels including OLEDs are arranged in the form of a matrix, and the levels of brightness of subpixels, selected based on scanning signals, are controlled depending on the gray scales of data.

There is increasing user demand for a mode in which simple text, a simple image, or the like, is displayed for user convenience, even in a case in which, for example, a user is not actively using an organic light-emitting display device, no images are to be displayed on an organic light-emitting display panel, or there are very few changes in images.

However, since this mode is an operation mode additionally provided for user convenience, instead of being an operation mode for displaying essential images on the screen, there is a restriction of low power consumption.

SUMMARY OF THE INVENTION

Various aspects of the present disclosure provide an organic light-emitting display panel, an organic light-emitting display device, a data driver, and a low power driving method that can effectively provide a simple display mode in which necessary information can be displayed for user convenience.

Also provided are an organic light-emitting display panel, an organic light-emitting display device, a data driver, and a low power driving method that can simply realize a simple display mode at a low level of power.

Also provided are an organic light-emitting display panel, an organic light-emitting display device, a data driver, and a low power driving method that can realize a simple display mode at a low level of power and reduce flickering in a simple display mode section.

According to an aspect, example embodiments may provide an organic light-emitting display device that can effectively display desirable information for user convenience, operate with lower power, and prevent or reduce flickering in a simple display mode section.

The organic light-emitting display device may include: an organic light-emitting display panel including an arrangement of a number of subpixels defined by a number of data lines and a number of gate lines; a data driver driving the number of data lines; and a gate driver driving the number of gate lines.

In the organic light-emitting display device, each of the number of subpixels may include: an organic light-emitting diode; a driving transistor driving the organic light-emitting diode; a switching transistor controlled by a scanning signal applied to a gate node through a corresponding gate line among the number of gate lines, the switching transistor being electrically connected between a first node of the driving transistor and a corresponding data line among the number of data lines; and a storage capacitor electrically connected between the first node and a second node of the driving transistor.

In the organic light-emitting display device, when switched to a simple display mode, the data driver may supply a specific voltage to the data line after data voltages are sequentially supplied to subpixels, among the number of subpixels, connected to the data line.

The specific voltage may be identical to a data voltage among the data voltages sequentially supplied to the subpixels connected to the data line.

More specifically, the specific voltage may be identical to a highest data voltage among the data voltages supplied to the subpixels connected to the data line.

The specific voltage may be a data voltage applied for displaying information in the simple display mode section.

The data voltage applied for displaying information in the simple display mode section may be, for example, a white gray scale voltage.

The specific voltage may not be any voltage among the data voltages sequentially supplied to the subpixels connected to the data line but may be a randomly set voltage.

The specific voltage may be a voltage differing from a data voltage among the data voltages sequentially supplied to the subpixels connected to the data line by a predetermined voltage.

The specific voltage may be a voltage differing from a highest data voltage among the data voltages sequentially supplied to the subpixels connected to the data line by a predetermined voltage.

The set voltage may be a fixed value that is constant during all driving or may be a variable value that is variously set in each driving, in specific circumstances, or for predetermined periods.

According to another aspect, example embodiments may provide an organic light-emitting display panel that can display desirable information for user convenience, operate with lower power, and prevent or reduce flickering in a simple display mode section.

In the organic light-emitting display panel, each of the number of subpixels may include: an organic light-emitting diode; a driving transistor driving the organic light-emitting diode; a switching transistor controlled by a scanning signal applied to a gate node through a corresponding gate line among the number of gate lines, the switching transistor being electrically connected between a first node of the driving transistor and a corresponding data line among the number of data lines; and a storage capacitor electrically connected between the first node and a second node of the driving transistor.

In the organic light-emitting display panel, after data voltages are sequentially supplied to the data line, a specific voltage may be supplied to the data line. The specific voltage may be identical to a data voltage among the data voltages sequentially supplied to the data line or be a randomly set voltage.

The specific voltage may be identical to a highest data voltage among the data voltages supplied to subpixels, among the number of subpixels, connected to the data line or may be a voltage differing from the highest data voltage by a predetermined voltage.

According to another aspect, example embodiments may provide a data driver driving data lines provided in an organic light-emitting display panel.

The data driver driving data may include: a latch circuit storing input image data therein; a digital-to-analog converter converting image data stored in the latch circuit into analog data voltages; and an output buffer outputting the data voltages to a data line.

In the data driver, after the data voltages are sequentially output to the data line, a specific voltage may be output to the data line.

The specific voltage may be identical to a data voltage among the data voltages output to the data line or may be a randomly set voltage.

The specific voltage may be identical to a highest data voltage among the data voltages output to the data line or may be a voltage differing from the highest data voltage by a predetermined voltage.

According to another aspect, example embodiments may provide a low voltage driving method of an organic light-emitting display device.

The low voltage driving method may include: sequentially outputting data voltages to a data line during a first section; and outputting a specific voltage to the data line during a second section after the first section.

The specific voltage may be identical to a data voltage among the data voltages output to the data line during the first section or may be a randomly set voltage. More specifically, the specific voltage may be identical to a highest data voltage among the data voltages output to the data line during the first section or may be a voltage differing from the highest data voltage by a predetermined voltage.

According to the present disclosure as set forth above, example embodiments can provide an organic light-emitting display panel, an organic light-emitting display device, a data driver, and a low power driving method that can effectively realize a simple display mode in which necessary information can be displayed for user convenience.

In addition, example embodiments can provide an organic light-emitting display panel, an organic light-emitting display device, a data driver, and a low power driving method that can simply realize a simple display mode at a low level of power.

According to an aspect, example embodiments may provide an organic light-emitting display device including an organic light-emitting display panel having a plurality of subpixels connected to data lines and gate lines; a data driver configured to drive the data lines; and a gate driver configured to drive the gate lines, wherein the organic light-emitting display device has a first mode having a first refresh rate and a second mode having a second refresh rate that is lower than the first refresh rate, the second mode having a first period and a second period that is subsequent to the first period, and wherein, in the first period of the second mode, the data driver sequentially supplies data voltages to at least two of the plurality of subpixels, and in the second period of the second mode, the data driver supplies a specific voltage to the plurality of subpixels, the specific voltage being the same as one of at least two of the data voltages sequentially supplied to the at least two subpixels.

The second period may be a data holding period.

The specific voltage may be the same as the highest voltage among the at least two of the data voltages supplied to the at least two subpixels.

The at least two subpixels may have at least one of a first luminance and a second luminance in the second mode, the first luminance may be higher than the second luminance, and the specific voltage may be supplied to one of the at least two subpixels that have the first luminance.

While the data driver is supplying the specific voltage to the data lines, the gate driver may supply scanning signals of turn-off level voltages to the gate lines corresponding to the at least two subpixels in the second period of the second mode.

When the specific voltage is supplied to the data lines, a leakage current need not be generated in a switching transistor of at least one subpixel among the at least two subpixels supplied with the specific voltage.

The specific voltage may be the same as a maximum of the at least two of the data voltages sequentially supplied to the at least two subpixels.

The specific voltage may be the same as the one data voltage that is supplied to the last of the at least two subpixels.

The organic light-emitting display panel may display images or text with at most a specific number of colors in a section of the second mode than the first mode.

The specific voltage may be supplied to the one of the at least two subpixels having an easily perceptible flicker.

The specific voltage may be supplied to the one of the at least two subpixels having a greater leakage current.

According to an aspect, example embodiments may provide a driving method for an organic light-emitting display device using a first mode having a first refresh rate and a second mode having a second refresh rate that is lower than the first refresh rate, the second mode having a first period and a second period that is subsequent to the first period, the method including sequentially supplying data voltages to at least two of a plurality of subpixels that are connected to data lines and gate lines in the first period of the second mode; and supplying a specific voltage to the plurality of subpixels in the second period of the second mode, the specific voltage being the same as one of at least two of the data voltages sequentially supplied to the at least two subpixels.

Furthermore, example embodiments can provide an organic light-emitting display panel, an organic light-emitting display device, a data driver, and a low power driving method that can realize a simple display mode at a low level of power and effectively prevent leakage current from being generated in the switching transistors in the subpixels, thereby effectively reducing flickering in a simple display mode section.

BRIEF DESCRIPTION OF THE DRAWINGS

The above and other objects, features and advantages of the present disclosure will be more clearly understood from the following detailed description when taken in conjunction with the accompanying drawings, in which.

DETAILED DESCRIPTION OF THE EMBODIMENTS

Figure 1:
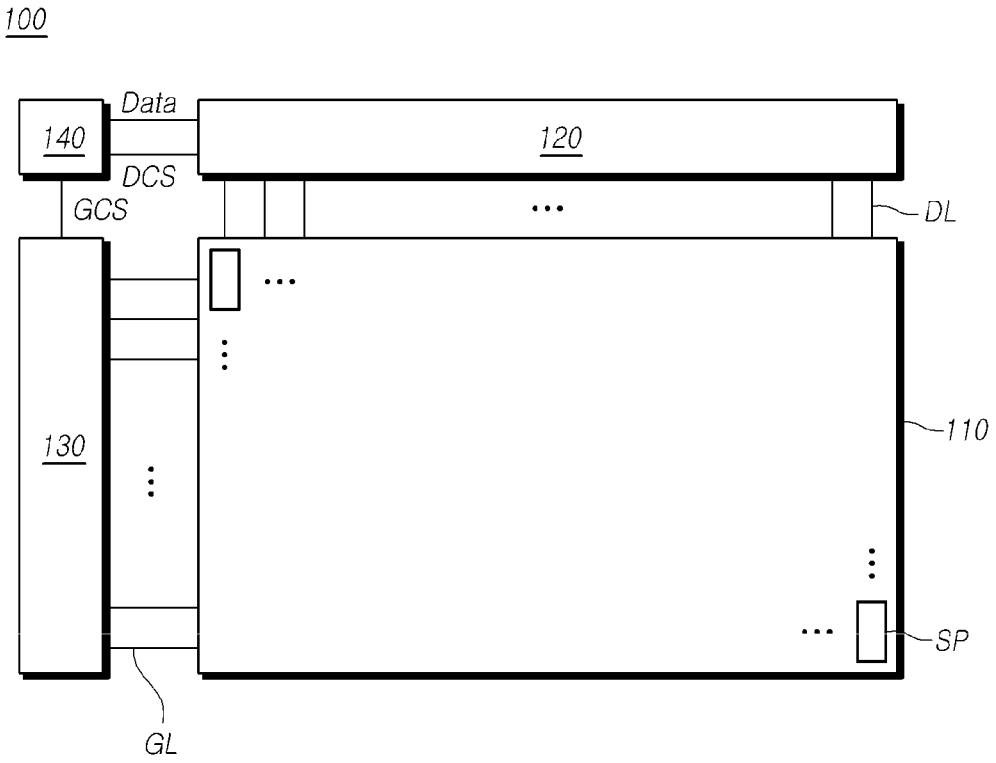
FIG. 1 is a schematic configuration view illustrating an organic light-emitting display device according to example embodiments.

Hereinafter, reference will be made to embodiments of the present disclosure in detail, examples of which are illustrated in the accompanying drawings. Throughout this document, reference should be made to the drawings, in which the same reference numerals and symbols will be used to designate the same or like components. In the following description of the present disclosure, detailed descriptions of known functions and components incorporated herein will be omitted in the case that the subject matter of the present disclosure may be rendered unclear thereby.

It will also be understood that, while terms such as "first," "second," "A," "B," "(a)," and "(b)" may be used herein to describe various elements, such terms are only used to distinguish one element from another element. The substance, sequence, order, or number of these elements is not limited by these terms. It will be understood that when an element is referred to as being "connected to" or "coupled to" another element, not only can it be "directly connected or coupled to" the other element, but it can also be "indirectly connected or coupled to" the other element via an "intervening" element. In the same context, it will be understood that when an element is referred to as being formed "on" or "under" another element, not only can it be directly formed on or under another element, but it can also be indirectly formed on or under another element via an intervening element.

FIG. 1 is a schematic configuration view illustrating an organic light-emitting display device 100 according to example embodiments.

Referring to FIG. 1, the organic light-emitting display device 100 according to example embodiments includes: an organic light-emitting display panel 110 on which a number of data lines DL and a number of gate lines GL are disposed and a number of subpixels SP defined by the number of data lines DL and the number of gate lines GL are arranged in the form of a matrix; a data driver 120 driving the number of data lines DL; a gate driver 130 driving the number of gate lines GL; and a controller 140 controlling the data driver 120 and the gate driver 130.

The controller 140 controls the data driver 120 and the gate driver 130 by supplying a variety of control signals to the data driver 120 and the gate driver 130.

The controller 140 starts scanning based on timing realized by each frame, converts image data input from an external source into a data signal format readable by the data driver 120 before outputting the converted image data, and regulates data processing at a suitable point in time in response to the scanning.

The controller 140 may be a timing controller used in the field of conventional displays or a control device performing other control functions including the function as the timing controller.

The controller 140 may be embodied as a component separate from the data driver 120 or may be embodied as an integrated circuit together with the data driver 120.

The data driver 120 drives the number of data lines DL by supplying data voltages to the number of data lines DL. Herein, the data driver 120 is also referred to as the "source driver."

The data driver 120 may be comprised of one or more source driver integrated circuits (SDICs).

Each of the SDICs may include, for example, a shift register, a latch circuit, a digital-to-analog converter (DAC), an output buffer, and the like.

Alternatively, each of the SDICs may further include an analog to digital converter (ADC).

The gate driver 130 sequentially drives the number of gate lines GL by sequentially supplying scanning signals to the number of gate lines GL. Herein, the gate driver 130 is also referred to as the "scanning driver."

The gate driver 130 may comprise one or more gate driver integrated circuits (GDICs).

Each of the GDICs may include, for example, a shift register, a level shifter, and the like.

The gate driver 130 sequentially supplies scanning signals respectively having an on or off voltage to the number of gate lines GL, under the control of the controller 140.

When a specific gate line among the number of gate lines GL is opened by the gate driver 130, the data driver 120 converts image data received from the controller 140 to analog data voltages and then supplies the analog data voltages to the number of data lines DL.

As illustrated in FIG. 1, the data driver 120 may be located on one side (e.g. above or below) of the organic light-emitting display panel 110. Alternatively, the data driver 120 may be located on both sides (e.g. above and below) of the organic light-emitting display panel 110 depending on the driving system, the design of the panel, and the like.

As illustrated in FIG. 1, the gate driver 130 may be located on one side (e.g. to the right of left) of the organic light-emitting display panel 110. Alternatively, the gate driver 130 may be located on both sides (e.g. to the right and left) of the organic light-emitting display panel 110 depending on the driving system, the design of the panel, and the like.

The controller 140 receives a variety of timing signals, including a vertical synchronization (Vsync) signal, a horizontal synchronization (Hsync) signal, an input data enable (DE) signal, and a clock signal, together with input image data, from an external source (e.g. a host system).

The controller 140 generates a variety of control signals by receiving a variety of timing signals, including a Vsync signal, an Hsync signal, an input DE signal, and a clock signal, and outputs the variety of control signals to the data driver 120 and the gate driver 130 to control the data driver 120 and the gate driver 130.

For example, the controller 140 outputs a variety of gate control signals (GCSs), including a gate start pulse (GSP), a gate shift clock (GSC), and a gate output enable (GOE) signal, to control the gate driver circuit 130.

Here, the GSP controls the operation start timing of one or more GDICs of the gate driver 130. The GSC is a clock signal commonly input to the one or more GDICs to control the shift timing of a scanning signal (or a gate pulse). The GOE signal designates the timing information of the one or more GDICs.

In addition, the controller 140 outputs a variety of data control signals (DCSs), including a source start pulse (SSP), a source sampling clock (SSC), and a source output enable (SOE) signal, to control the data driver 120.

Here, the SSP controls the data sampling start timing of one or more SDICs of the data driver 120. The SSC is a clock signal controlling the data sampling timing of each of the SDICs. The SOE signal controls the output timing of the data driver 120.

Each of the subpixels SP arranged in the organic light-emitting display panel 110 includes circuit elements, such as an organic light-emitting diode (OLED) able to emit light by itself and a driving transistor driving the OLED.

The types and number of the circuit elements of each subpixel may be determined variously, depending on the function and design of the subpixel.

Figure 2:
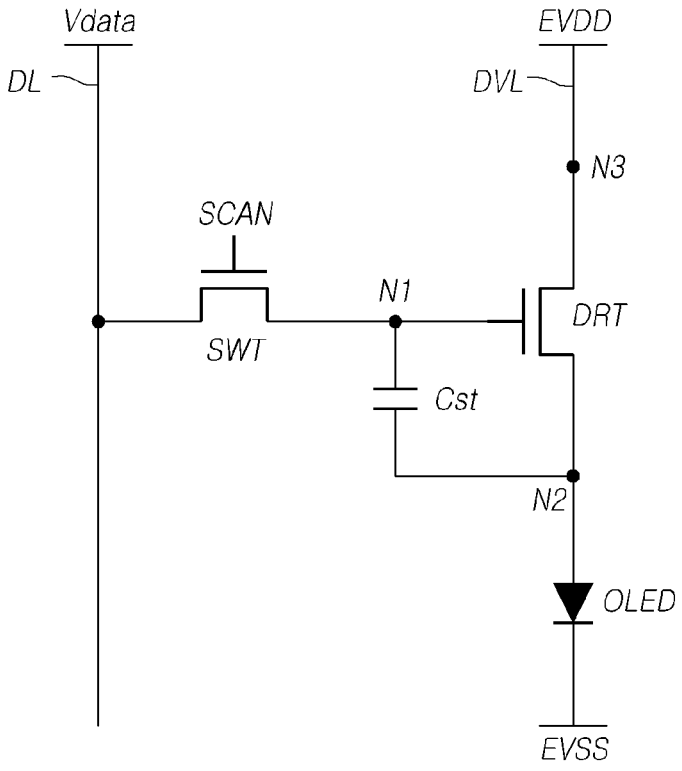
FIG. 2 illustrates an example subpixel structure of the organic light-emitting display device according to example embodiments.

FIG. 2 illustrates an example structure of the subpixel SP of the organic light-emitting display device 100 according to example embodiments.

Referring to FIG. 2, in the organic light-emitting display device 100 according to example embodiments, each of the subpixels SP basically includes an OLED, a driving transistor DRT driving the OLED, a switching transistor SWT transferring a data voltage to a first node N1 corresponding to a gate node of the driving transistor DRT, and a storage capacitor Cst maintaining a data voltage corresponding to an image signal voltage or a voltage corresponding to the data voltage for a period of a single frame. The OLED includes a first electrode (e.g. an anode or a cathode), an organic layer, a second electrode (e.g. a cathode or an anode), and the like.

A base voltage EVSS is applied to the second electrode of the OLED. The driving transistor DRT drives the OLED by supplying a driving current to the OLED. The driving transistor includes a first node N1, a second node N2, and a third node N3. The first node N1 of the driving transistor DRT is a node corresponding to a gate node and is electrically connected to a source node or a drain node of the switching transistor SWT. The second node N2 of the driving transistor DRT is electrically connected to a first electrode of the OLED and is a source node or a drain node. The third node N3 of the driving transistor DRT is a node to which a driving voltage EVDD is applied. The third node N3 is electrically connected to a driving voltage line DVL through which the driving voltage EVDD is supplied and is a drain node or a source node.

The driving transistor DRT and the switching transistor SWT may be embodied as N-type transistors, as illustrated in FIG. 2, or may be embodied as P-type transistors.

The switching transistor SWT is electrically connected between a corresponding data line DL and the first node N1 of the driving transistor DRT. The switching transistor SWT can be controlled by a scanning signal SCAN applied to the gate node through a corresponding gate line.

The switching transistor SWT can be turned on by a scanning signal SCAN to transfer a data voltage Vdata, supplied from the data line DL, to the first node N1 of the driving transistor DRT.

The storage capacitor Cst is electrically connected between the first node N1 and the second node N2 of the driving transistor DRT.

The storage capacitor Cst is not a parasitic capacitor, e.g. Cgs or Cgd, i.e. an internal capacitor located between the first node N1 and the second node N2 of the driving transistor DRT, but is an external capacitor intentionally designed to be located outside of the driving transistor DRT.

The subpixel structure illustrated in FIG. 1 is a representative subpixel structure. Each of the subpixels having this structure may further include one or more transistors and/or one or more capacitors.

Figure 3:
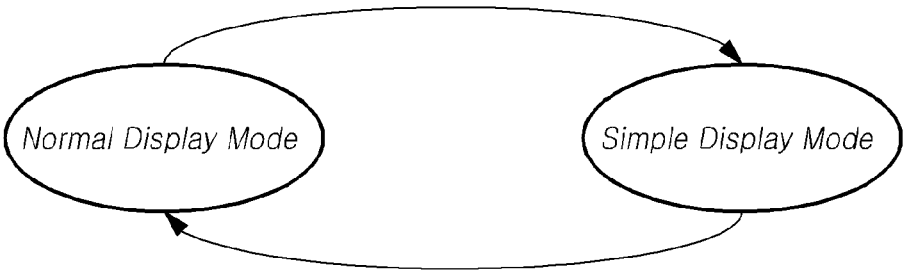
FIG. 3 is a state diagram illustrating the operating modes of the organic light-emitting display device according to example embodiments.
Figure 4:
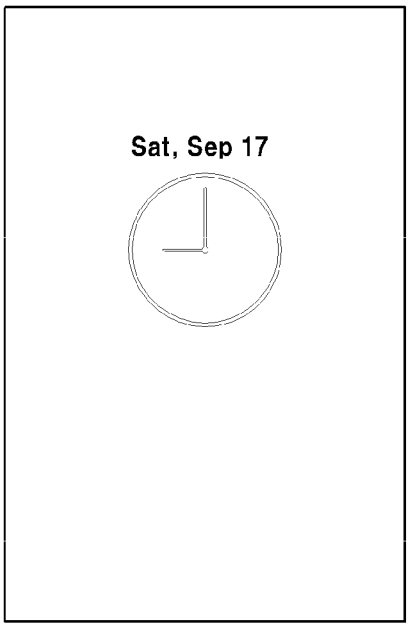
FIG. 4 illustrates an example image captured from the screen in a simple display mode section of the organic light-emitting display device according to example embodiments.

FIG. 3 is a state diagram illustrating the operating modes of the organic light-emitting display device 100 according to example embodiments, and FIG. 4 illustrates an example image captured from the screen in a simple display mode section of the organic light-emitting display device 100 according to example embodiments.

Referring to FIG. 3, the organic light-emitting display device 100 according to example embodiments can selectively operate in a normal display mode (e.g., a first mode) to display typical images on the screen or in a simple display mode (e.g., a second mode) to display a simple image on the screen, instead of typical images.

Switching between the normal display mode and the simple display mode can be triggered as a user manipulates a button disposed on the organic light-emitting display device 100 or touches a touchscreen panel disposed inside or outside of the organic light-emitting display panel 110, or alternatively, can be triggered at a point in time during mode switching after a predetermined period of time set by a timer has elapsed.

When mode switching is triggered as described above, a control signal for instructing a specific operation mode can be generated.

To operate the organic light-emitting display panel 110 at a frame rate corresponding to each operation mode in response to the control signal, data driving by the data driver 120 and gate driving by the gate driver 130 are performed.

The organic light-emitting display device 100 according to example embodiments may be, for example, a mobile terminal, such as a smartphone or a tablet computer, a monitor of a computer or the like, or an image display device, such as a television (TV).

The simple display mode of the organic light-emitting display device 100 is a mode in which only a simple text or a simple image is displayed for user convenience in a case in which the user does not use the organic light-emitting display device 100, in a case in which there is no image to be displayed on the organic light-emitting display device 100, or in a case in which there are very few changes in images.

In a mobile terminal, such as a smartphone, the normal display mode may be an operation mode for displaying an unlocked screen (a screen that is generally used), an operation mode for displaying a locked screen, or the like.

The simple display mode may be an operation mode for displaying a specific piece of information in a specific area of the screen while the remaining area of the screen is displayed as black, instead of displaying an unlocked screen (a normal screen) or a locked screen. The simple display mode may also be referred to as a low power mode or a standby mode.

However, the simple display mode must be designed to minimize power consumption, since the simple display mode is not an operation mode for displaying essential images on the screen but is additionally provided for user convenience.

That is, a significantly low amount of power must be consumed in the simple display mode, as compared to the normal display mode.

In this regard, in the simple display mode section, the organic light-emitting display panel 110 can display at least one among images and text with, for example, a specific number of, or fewer, colors (e.g. two to five colors, including black and white).

For example, in the simple display mode section, at least one piece of information regarding time, a date, a calendar, or the like can be displayed on the organic light-emitting display panel 110.

In this manner, in the simple display mode section, it is possible to constantly display desirable information on the organic light-emitting display panel 110 by expressing limited colors on the organic light-emitting display panel 110 and only displaying a simple image or text on the organic light-emitting display panel 110, thereby improving user convenience while minimizing power consumption.

As described above, it is desirable for the simple display mode to minimize power consumption, since the simple display mode is an additional display mode provided for user convenience.

In the simple display mode section, the organic light-emitting display device 100 according to example embodiments can drive the organic light-emitting display panel 110 at a low refresh rate or a low frame rate to reduce power consumption.

Hereinafter, a driving method in the simple display mode section will be referred to as "low power driving" or "low refract rate (LLR) driving."

Briefly describing low power driving, in the simple display mode section, the data driver 120 can output data voltages at a restricted frequency rate, in response to a control signal for instructing a simple display mode being received from the controller 140.

In the above-described simple display mode section, the gate driver can pause transmission of scanning signals through specific gate lines, in response to the control signal for instructing a simple display mode being received from the controller 140.

The data driver 120 is configured to receive the control signal for instructing a simple display mode from the controller 140 and control the refresh rates of image contents.

For example, when image contents are rapidly changing image contents (e.g. video images), the controller 140 provides the data driver 120 with a control signal for instructing a normal display mode, such that the data driver 120 processes image data at a predetermined normal refresh rate.

Then, the data driver 120 outputs data voltages Vdata at a general refresh rate. That is, pieces of image data for each frame are processed for all frame sections.

In contrast, when image contents are still contents (or slowly changing contents), the controller 140 provides the data driver 120 with a control signal for instructing a simple display mode.

In this case, the data driver 120 processes image data at a refresh rate that is lower than a general refresh rate.

That is, refresh rates in all simple display mode sections are lower than refresh rates in general display mode sections.

In the simple display mode section, image data of a single frame may be processed for a predetermined frame section in which data voltages Vdata are set to be output at a lower refresh rate.

In this regard, the data driver 120 performs normal data processing only in a specific frame section (e.g., a first period of the second mode)), and subpixels are updated with new data voltages Vdata only in the specific frame section (e.g., a second period of the second mode). This can consequently reduce the power consumption of the display panel.

Hereinafter, low power driving in a simple display mode section will be described in more detail. For the sake of explanation, a case in which n number of subpixels . . . , SP(n−2), SP(n−1), and SP(n) are connected to a single data line DL will be taken by way of example.

Figure 5:
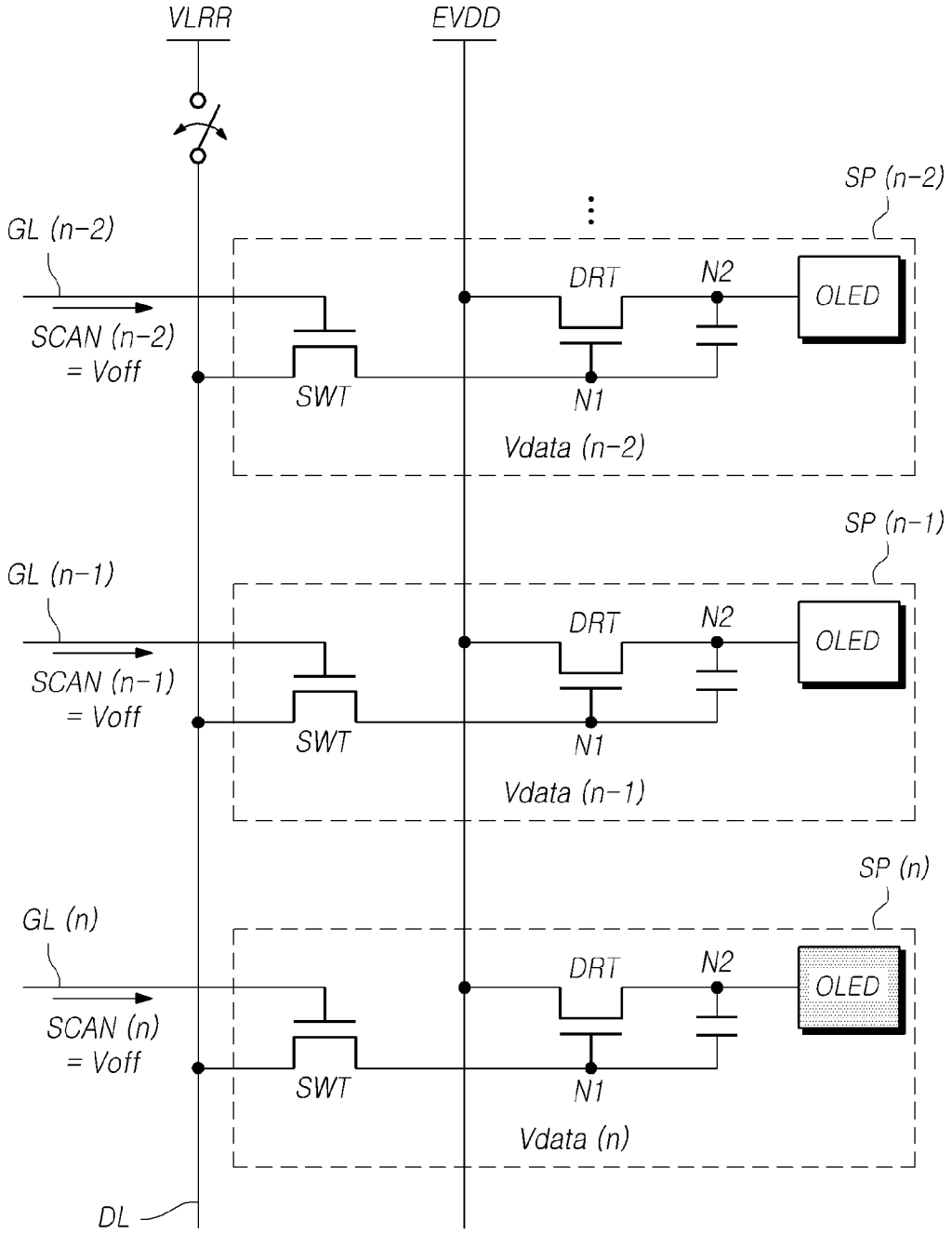
FIG. 5 illustrates low power driving of the organic light-emitting display device according to example embodiments in a simple display mode.

FIG. 5 illustrates low power driving of the organic light-emitting display device 100 according to example embodiments in a simple display mode.

In the subpixels . . . , SP(n−2), SP(n−1), and SP(n) of the organic light-emitting display panel 110, data voltages . . . , Vdata(n−2), Vdata(n−1), and Vdata(n) corresponding to gray scale voltages for displaying an image are applied to first nodes N1 of driving transistors DRT corresponding to gate nodes, and switching transistors SWT are turned off to hold the data voltages . . . , Vdata(n−2), Vdata(n−1), and Vdata(n).

In a data holding section in which the data voltages . . . , Vdata(n−2), Vdata(n−1), and Vdata (n) are held, scanning signals . . . , SCAN(n−2), SCAN(n−1), and SCAN(n) of turn-off level voltages Voff are supplied to the gate lines . . . , GL(n−2), GL(n−1), and GL(n) to turn off the switching transistors SWT.

In the data holding section of the simple mode section (e.g., the second period of the second mode), the data line DL has a voltage state of a specific voltage VLRR.

Figure 6:
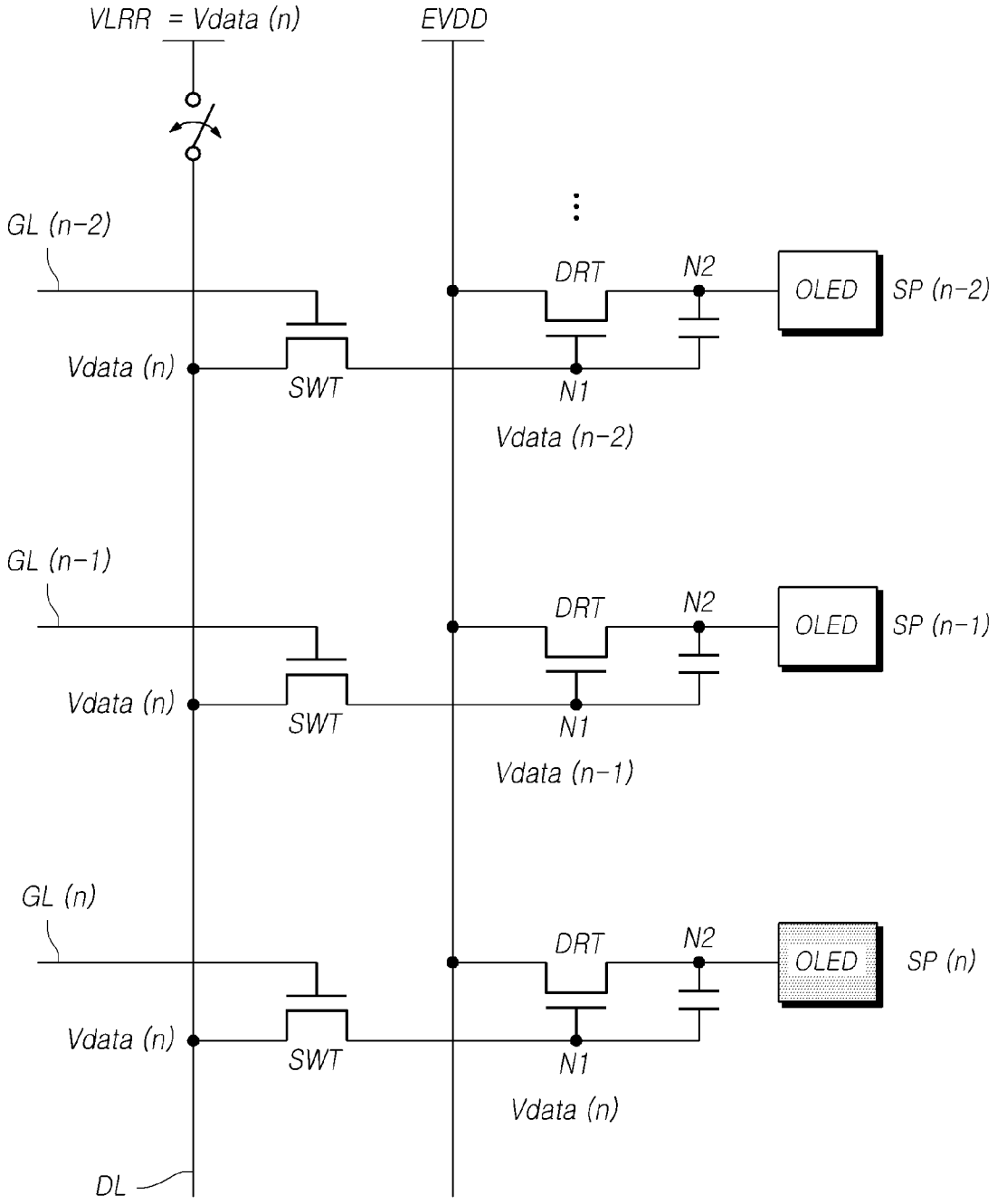
FIG. 6 illustrates a first low power driving method of the organic light-emitting display device according to example embodiments in a simple display mode.

FIG. 6 illustrates a first low power driving method of the organic light-emitting display device 100 according to example embodiments in a simple display mode.

Referring to the first low power driving method of the organic light-emitting display device 100 in the simple display mode illustrated in FIG. 6, in a data holding section, the data line DL has a voltage state of a specific voltage VLRR corresponding to the data voltage Vdata(n) supplied to the subpixel corresponding to the last gate line GL(n).

In the data holding section, differences in voltage between the source nodes and the drain nodes of the switching transistors SWT of the subpixels . . . , SP(n−2), SP(n−1), and SP(n) connected to the data line DL are determined by the data voltages . . . , Vdata(n−2), Vdata(n−1), and Vdata(n) applied to the gate nodes N1 of the driving transistors DRT and the data voltage Vdata(n) supplied to the subpixel SP(n) corresponding to the last gate line GL(n).

Thus, in the data holding section, there is a high likelihood that a difference in voltage between the source node and the drain node of the switching transistor SWT will be present among the subpixels . . . , SP(n−2), and SP(n−1), except for the subpixel SP(n), corresponding to the last gate line GL(n).

Figure 7:
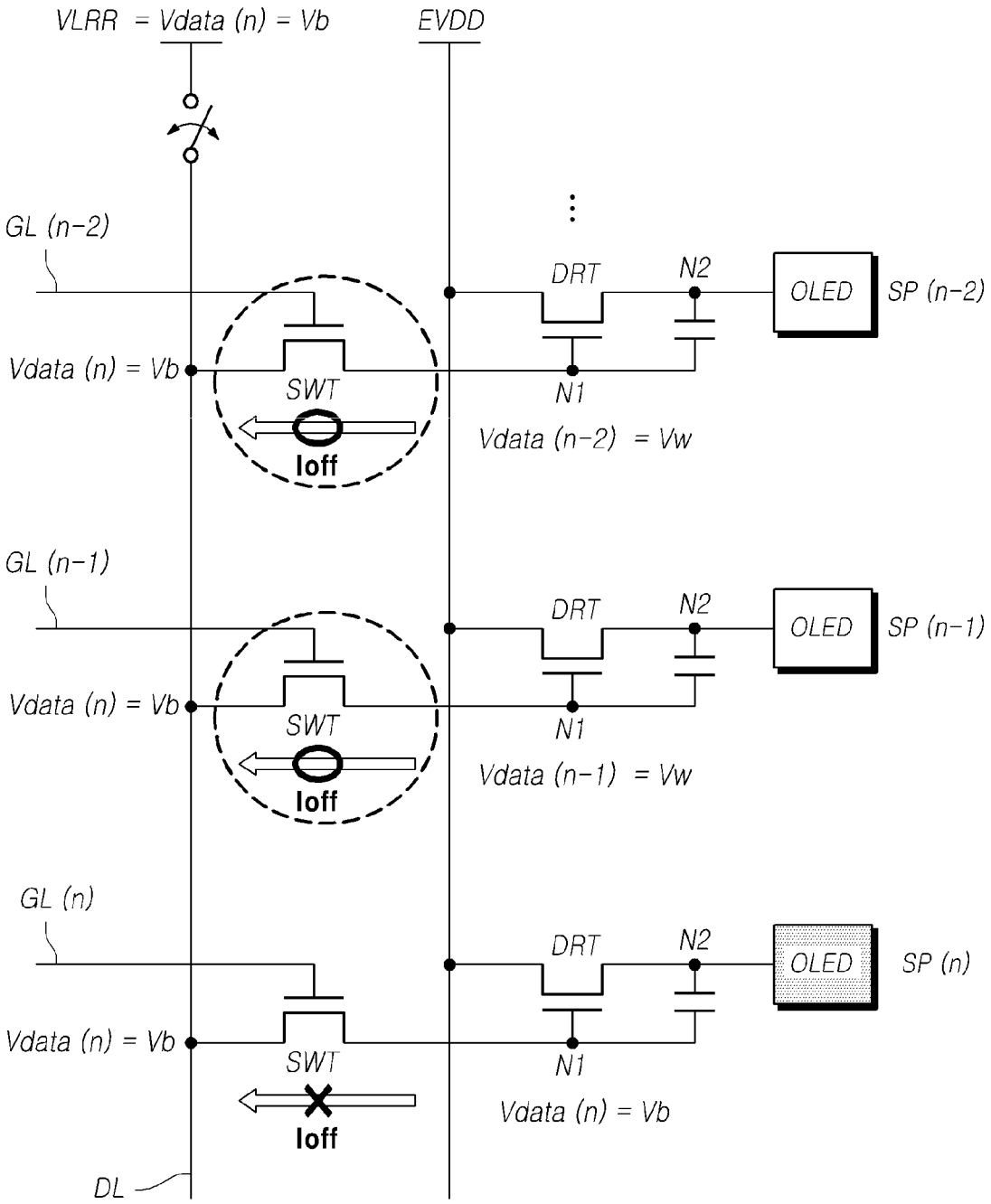
FIG. 7 illustrates a leakage current generated in the first low power driving method of the organic light-emitting display device according to example embodiments in the simple display mode.
Figure 8:
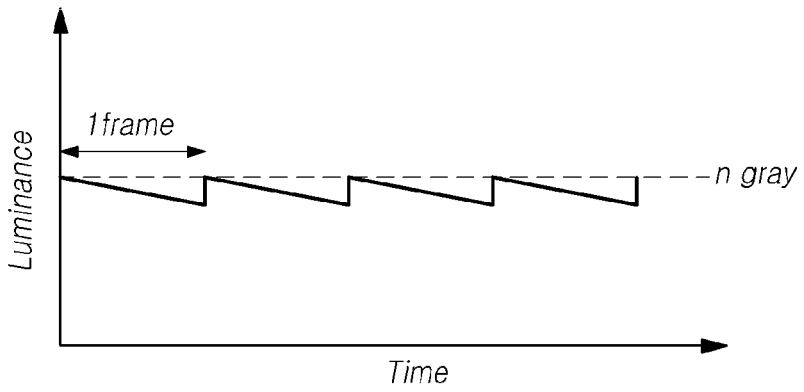
FIG. 8 is a graph illustrating decreases in luminance caused by the leakage current generated in the first low power driving method of the organic light-emitting display device according to example embodiments in the simple display mode.

FIG. 7 illustrates a leakage current Ioff generated in the first low power driving method of the organic light-emitting display device 100 according to example embodiments in the simple display mode, and FIG. 8 is a graph illustrating decreases in luminance caused by the leakage current Ioff generated in the first low power driving method of the organic light-emitting display device 100 according to example embodiments in the simple display mode.

Referring to FIG. 7, according to the first low power driving method, although the switching transistors SWT are controlled to be turned off in the data holding section, a difference in voltage may be formed between the source node and the drain node of each of the switching transistors SWT, so that a leakage current may be generated between the source node and the drain node of each of the switching transistors SWT.

For example, after the data voltage Vdata(n−2) corresponding to a white gray scale voltage Vw is applied to the gate node N1 of the driving transistor DRT of the subpixel SP(n−2), the data voltage Vdata(n−1) corresponding to a white gray scale voltage Vw is applied to the gate node N1 of the driving transistor DRT of the subpixel SP(n−1), and the data voltage Vdata(n) corresponding to a black gray scale voltage Vb is applied to the gate node N1 of the driving transistor DRT of the subpixel SP(n), the data holding section follows.

In the data holding section, the data voltage Vdata(n) supplied to the subpixel SP(n) connected to the last gate line GL(n) is applied as a specific voltage VLRR to the data line DL.

In the data holding section, although the switching transistors SWT are controlled in an off state, a difference in voltage Vw−Vb may be formed between the drain node and the source node of each of the switching transistors SWT of the subpixels SP(n−2) and SP(n−1), so that the leakage current Ioff may be generated in the switching transistors SWT.

When the leakage current Ioff is generated, the voltages of the gate nodes N1 of the driving transistors DRT are lowered.

This consequently reduces current flowing through the driving transistor DRT, thereby reducing luminance. The luminance reduced as described above may cause flickering, such as screen blinking.

This phenomenon may become more evident as the data holding section is longer, i.e. when the refresh rate is lower.

Hereinafter, a second low power driving method able to prevent flickering while reducing power consumption in a simple display mode will be described.

Figure 9:
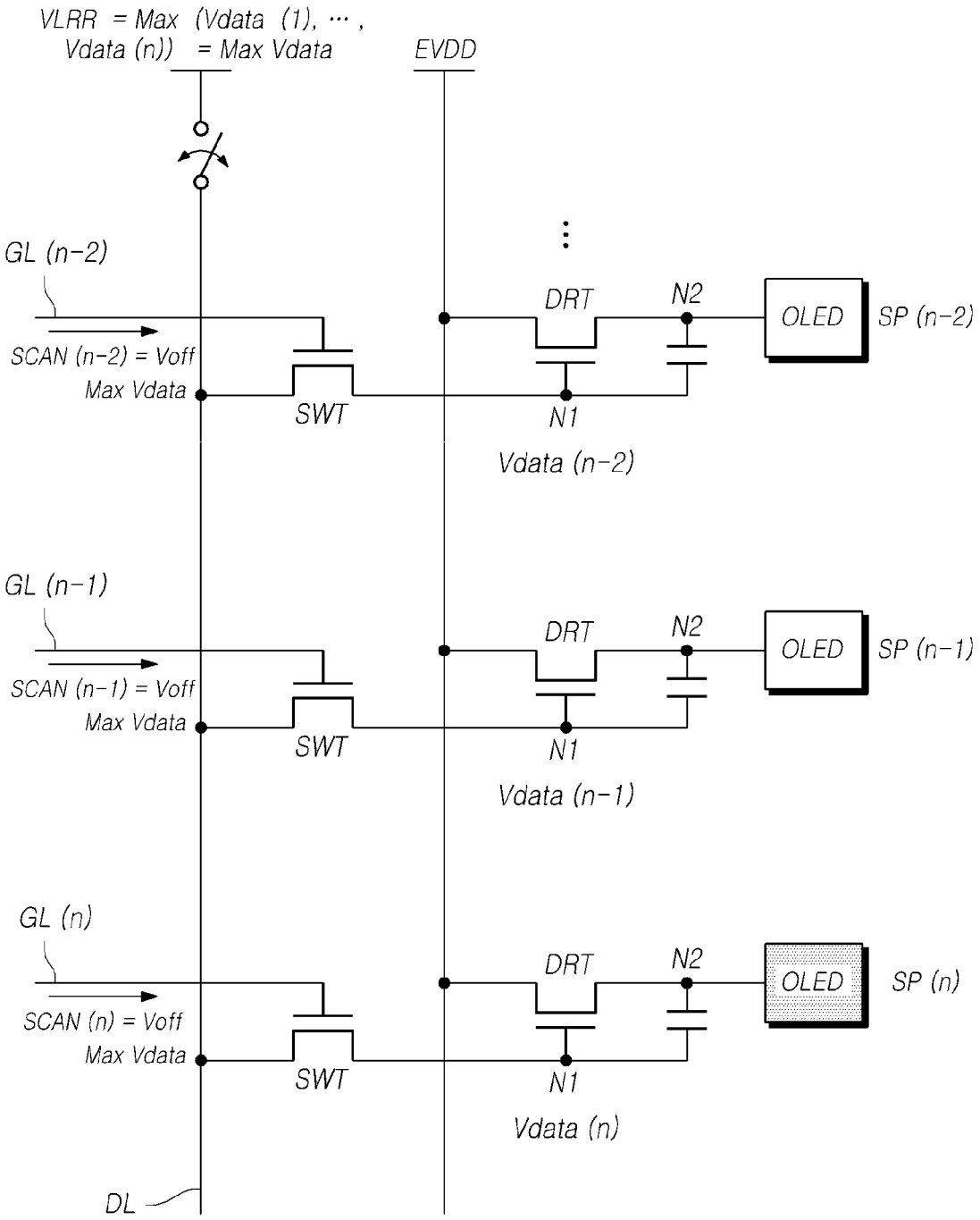
FIGS. 9 and 10 illustrate a second low power driving method of the organic light-emitting display device according to example embodiments in a simple display mode.
Figure 10:
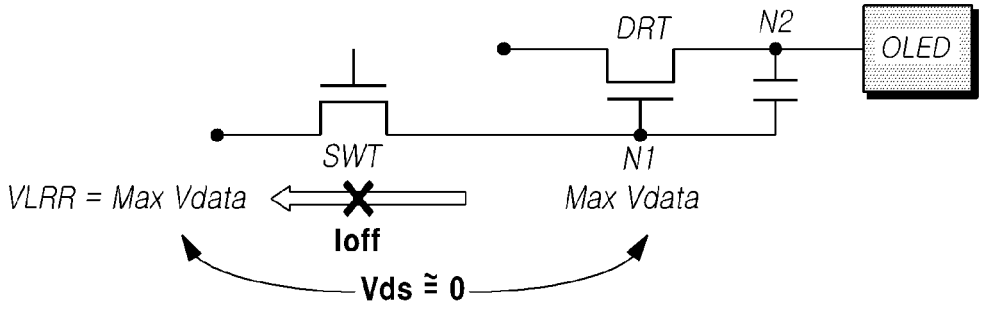

FIGS. 9 and 10 illustrate a second low power driving method of the organic light-emitting display device 100 according to example embodiments in a simple display mode.

Referring to FIG. 9, in the organic light-emitting display device 100 according to example embodiments, when switched to a simple display mode, the data driver 120 can supply a specific voltage VLRR to the data line DL in a data holding section, after data voltages . . . , Vdata(n−2), Vdata(n−1), and Vdata(n) are sequentially supplied to the subpixels . . . , SP(n−2), SP(n−1), and SP(n) connected to the data line DL.

The specific voltage VLRR corresponds to a driving enable voltage having a low refresh rate (LRR), or an LRR driving enable voltage, supplied to the data line DL in the data holding section.

The specific voltage VLRR may be identical to one data voltage among the data voltages . . . , Vdata(n−2), Vdata (n−1), and Vdata(n) sequentially supplied to the subpixels . . . , SP(n−2), SP(n−1), and SP(n) connected to the data line DL.

As described above, in the simple mode section, one data voltage selected from among the data voltages . . . , Vdata(n−2), Vdata(n−1), and Vdata(n) sequentially supplied to the subpixels . . . , SP(n−2), SP(n−1), and SP(n) connected to the data line DL can be supplied to the data line DL during the data holding section, whereby the specific voltage VLRR corresponding to the LRR driving enable voltage can be easily and simply set.

While the data driver 120 is supplying the specific voltage VLRR to the data line DL, the gate driver 130 can supply scanning signals . . . , SCAN(n−2), SCAN(n−1), and SCAN (n) of turn-off level voltages Voff to the gate lines . . . , GL(n−2), GL(n−1), and GL(n) corresponding to the subpixels . . . , SP(n−2), SP(n−1), and SP(n) connected to the data line DL.

As described above, the switching transistors SWT of the subpixels can be controlled to be in the off state in the data holding section.

Referring to FIG. 9, the specific voltage VLRR may be identical to a highest data voltage Max(Vdata(1), . . . , and Vdata(n))=Max Vdata among the data voltages . . . , Vdata (n−2), Vdata(n−1), and Vdata(n) supplied to the subpixels . . . , SP(n−2), SP(n−1), and SP(n) connected to the data line DL.

Thus, in the subpixel to which the highest data voltage Max Vdata is supplied, the difference in voltage between both ends of the switching transistor SWT is substantially zero (0), so that a leakage current is not generated.

When the subpixel to which the highest data voltage Max Vdata outputs the highest level of luminance, flickering may be most acutely recognized in the subpixel when luminance is lowered, due to the leakage current.

The above-described feature can prevent the leakage current in the high luminance subpixel in which flickering would otherwise be most acutely recognized. Thus, flickering can be more efficiently reduced.

Figure 11:
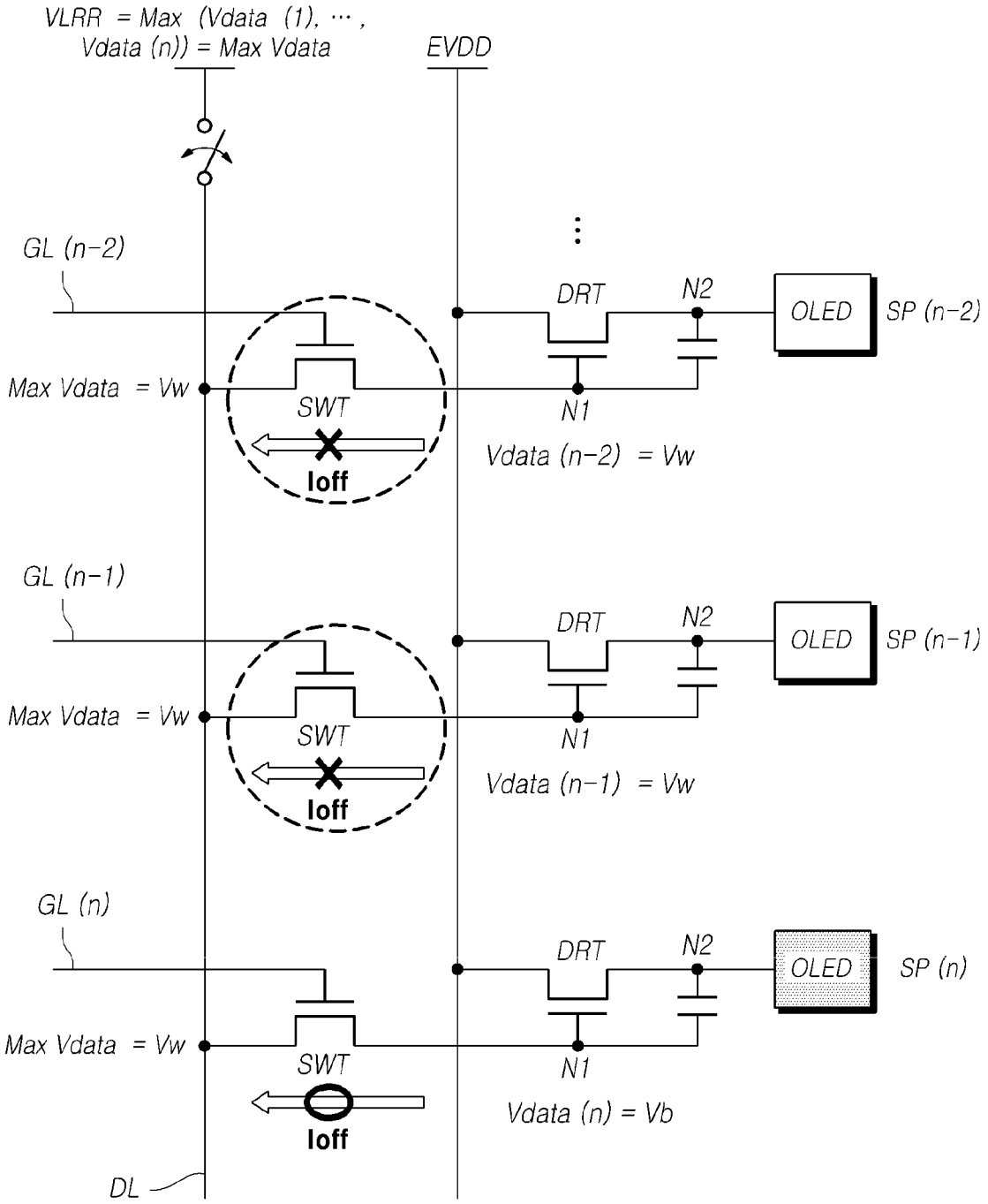
FIG. 11 illustrates a case in which the leakage current is effectively prevented by the second low power driving method of the organic light-emitting display device according to example embodiments in the simple mode.

FIG. 11 illustrates a case in which the leakage current Ioff is effectively prevented by the second low power driving method of the organic light-emitting display device 100 according to example embodiments in the simple mode.

Referring to FIG. 11, when a specific voltage VLRR=Max Vdata is supplied to the data line DL, the leakage current Ioff is not generated in the switching transistor SWT in at least one subpixel SP(n−2) and/or SP(n−1) among the subpixels . . . , SP(n−2), SP(n−1), and SP(n) connected to the data line DL.

Thus, during the simple display mode section, in the data holding section, it is possible to prevent luminance from being lowered by the leakage current Ioff in the at least one subpixel SP(n−2) and/or SP(n−1).

In addition, in the subpixel (SP(n)) among the subpixels . . . , SP(n−2), SP(n−1), and SP(n) connected to the data line DL, except for the at least one subpixel SP(n−2) and/or SP(n−1), the leakage current Ioff may be generated in the switching transistor SWT.

Thus, when the data voltages . . . , Vdata(n−2), Vdata(n−1), and Vdata(n) are sequentially supplied to the subpixels . . . , SP(n−2), SP(n−1), and SP(n) connected to the data line DL before the supply of the specific voltage VLRR to the data line DL, the data voltages Vdata(n−2) and Vdata(n−1) supplied to the at least one subpixel SP(n−2) and/or SP(n−1) are identical to the specific voltage VLRR, and the data voltage Vdata(n) supplied to the other subpixel SP(n) is lower than the specific voltage VLRR.

In this case, when the specific voltage VLRR=Max Vdata is supplied to the data line DL, the at least one subpixel SP(n−2) and/or SP(n−1), in which the leakage current Ioff is not generated, among the subpixels . . . , SP(n−2), SP(n−1), and SP(n) connected to the data line DL, is the subpixel to which a data voltage Max Vdata (e.g. Max Vdata=Vw) identical to the specific voltage VLRR was supplied.

Thus, in the data holding section during the simple display mode section, when the specific voltage VLRR=Max Vdata is supplied to the data line DL, the voltage difference Vds between both ends of the switching transistor SWT of the at least one subpixel SP(n−2) and/or SP(n−1), among the subpixels . . . , SP(n−2), SP(n−1), and SP(n) connected to the data line DL, is substantially zero (0), whereby the leakage current Ioff can be prevented from being generated in the switching transistor SWT.

Referring to FIG. 11, when the data voltages . . . , Vdata(n−2), Vdata(n−1), and Vdata(n) are sequentially supplied to the subpixels . . . , SP(n−2), SP(n−1), and SP(n) connected to the data line DL before the supply of the specific voltage VLRR to the data line DL, the data voltage Vdata(n−2) and/or Vdata(n−1) supplied to the at least one subpixel SP(n−2) and/or SP(n−1) may be a data voltage for displaying information in the simple display mode section.

For example, the data voltage for displaying information in the simple display mode section may be a white gray scale voltage Vw.

Thus, a leakage current can be prevented from being generated in a subpixel in an information display area having a white gray scale in which flickering would otherwise be most acutely recognized. It is therefore possible to more effectively reduce flickering.

Figure 12:
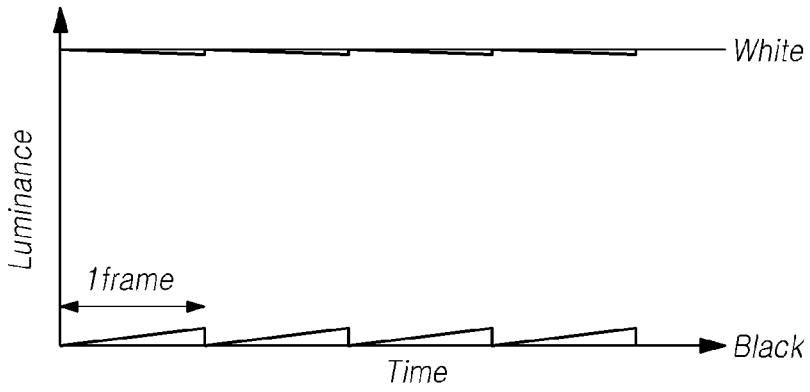
FIG. 12 is a graph illustrating a flickering reducing effect by the second low power driving method of the organic light-emitting display device according to example embodiments in the simple mode.

FIG. 12 is a graph illustrating a flickering reducing effect by the second low power driving method of the organic light-emitting display device 100 according to example embodiments in the simple mode.

Referring to FIG. 12, it can be appreciated that the above-described second low power driving method significantly reduces the lowering of luminance in a subpixel (e.g. SP(n−2) or SP(n−1) illustrated in FIG. 11) included in the information display area in which flickering may be more acutely recognized due to the application of white gray scale voltages.

In contrast, in a subpixel (e.g. SP(n) illustrated in FIG. 11) corresponding to an information non-display area to which black gray scale voltages are applied, the leakage current Ioff is still generated by the second low power driving method, so that luminance is lowered.

However, since the level of luminance of the subpixel (e.g. SP(n)) corresponding to the information non-display area to which black gray scale voltages are applied is basically low, the luminance is not lowered to a significant level, even in the case in which the leakage current Ioff is generated in the switching transistor SWT. Thus, substantially no flickering may be recognized or perceived.

Hereinafter, the data driver 120 for providing the low power driving method in the simple display mode section as described above will be briefly described.

Figure 13:
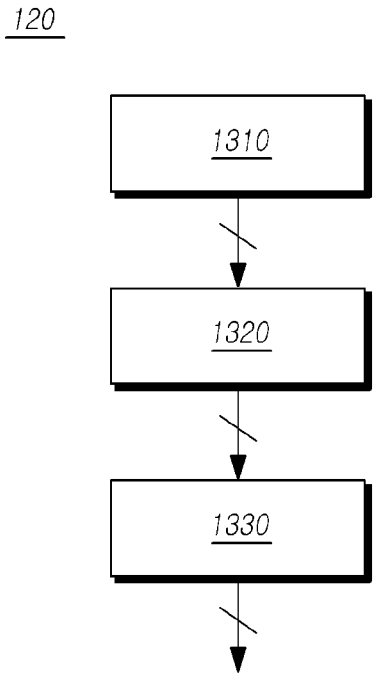
FIG. 13 is a block diagram illustrating the data driver of the organic light-emitting display device according to example embodiments.

FIG. 13 is a block diagram illustrating the data driver 120 of the organic light-emitting display device 100 according to example embodiments.

Referring to FIG. 13, the data driver 120 of the organic light-emitting display device 100 according to example embodiments includes a latch circuit 130 storing input image data therein, a digital-to-analog converter (DAC) 1320 converting the image data stored in the latch circuit 1310 to analog data voltages Vdata, and an output buffer 1330 outputting the data voltages Vdata to the data line DL.

After data voltages . . . , Vdata(n−2), Vdata(n−1), and Vdata(n) are sequentially output to the data line DL, the data driver 120 can output a specific voltage VLRR to the data line DL.

The specific voltage VLRR corresponds to an LRR driving enable voltage. The specific voltage VLRR may be one data voltage among data voltages . . . , Vdata(n−2), Vdata(n−1), and Vdata(n) output to the data line DL.

The use of the above-described data driver 120 can reduce power consumption by simply realizing LRR driving in the simple display mode section.

The above-described specific voltage VLRR may be the highest data voltage among the data voltages . . . , Vdata(n−2), Vdata(n−1), and Vdata(n) output to the data line DL during a first section.

This can consequently prevent the leakage current in a high-luminance subpixel in which flickering is most acutely recognizable, thereby more effectively reducing flickering.

Figure 14:
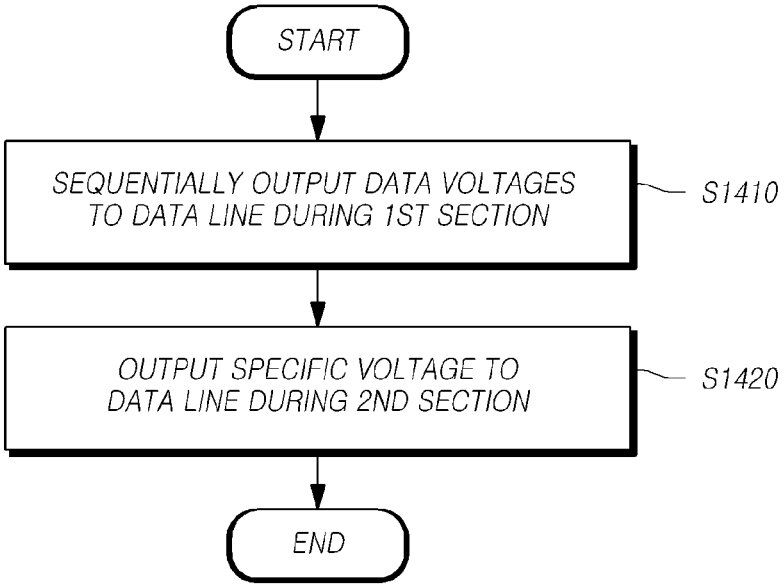
FIG. 14 is a flowchart illustrating a low power driving method of the organic light-emitting display device according to example embodiments.

FIG. 14 is a flowchart illustrating a low power driving method of the organic light-emitting display device 100 according to example embodiments.

Referring to FIG. 14, the low power driving method of the organic light-emitting display device 100 according to example embodiments includes: an operation S1410 of sequentially outputting data voltages . . . , Vdata(n−2), Vdata(n−1), and Vdata(n) to a data line DL during a first section; and an operation S1420 of outputting a specific voltage VLRR to the data line DL during a second section after the first section.

The first section and the second section described above are sections included in the simple display mode section. The first section is the section during which data voltages are supplied to display information, while the second section corresponds to the data holding section during which supplied data voltages are held.

The specific voltage VLRR as described above may be one data voltage among the data voltages . . . , Vdata(n−2), Vdata(n−1), and Vdata(n) output to the data line DL during the first section.

The use of the driving method as described above can reduce power consumption by easily and simply realizing LRR driving while providing user convenience by only displaying information required for the simple display mode section.

The specific voltage VLRR as described above may be the highest data voltage among the data voltages . . . , Vdata (n−2), Vdata(n−1), and Vdata(n) output to the data line DL during the first section.

This can consequently prevent the leakage current in a high-luminance subpixel in which flickering may be most acutely recognized, thereby more effectively reducing flickering.

Figure 15:
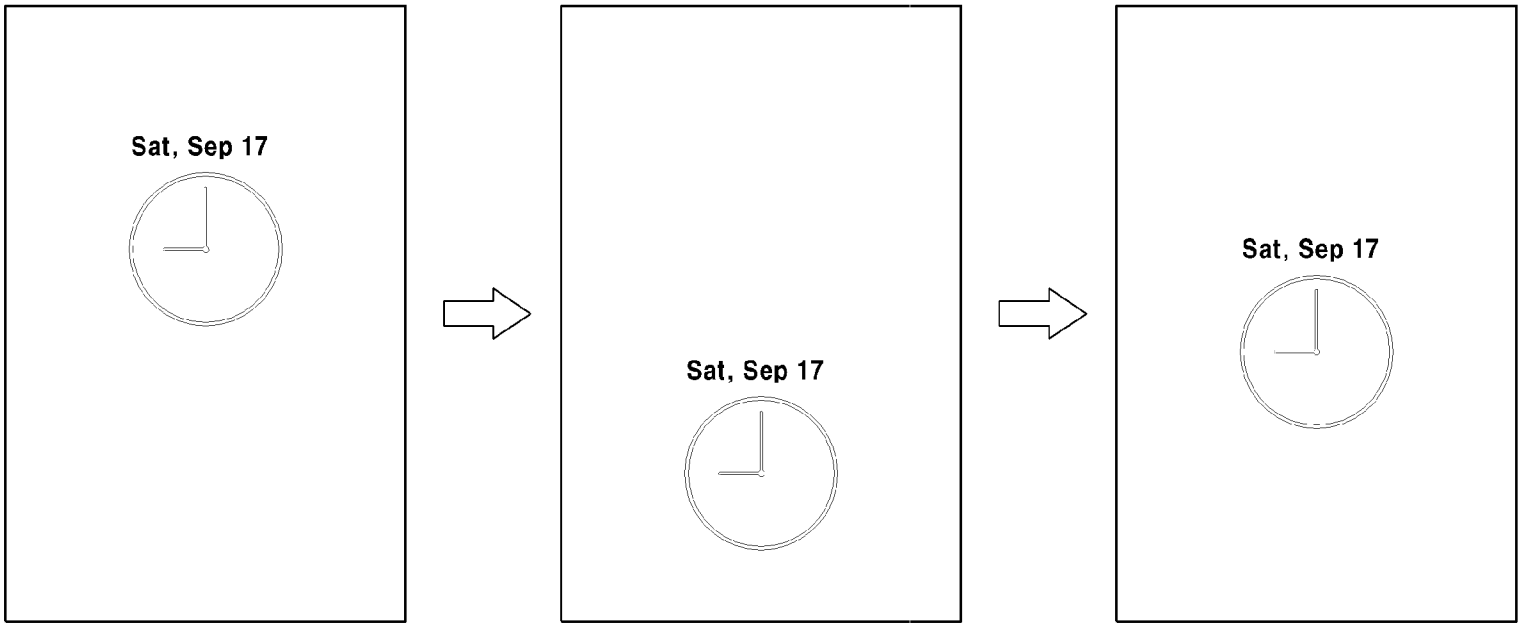
FIG. 15 illustrates changes in the position of an information display area in a simple display mode section, performed by the organic light-emitting display device according to example embodiments.

FIG. 15 illustrates changes in the position of an information display area in a simple display mode section, performed by the organic light-emitting display device 100 according to example embodiments.

Referring to FIG. 15, the position of the information display area (e.g. an area in which information regarding time, a date, a calendar, or the like is displayed) in the simple display mode section may change over time, although the position of the information display area can be fixed.

Above-described changes in the position of the information display area in the simple display mode section can reduce variations in driving time among the circuit elements (e.g. the OLED, the driving transistor DRT, or the like), thereby reducing variations in the degree of deterioration among the subpixels. This can consequently reduce variations in luminance among the subpixels while ensuring the circuit elements have uniform lifetimes.

In addition, the form of information displayed in the information display area (e.g. an area in which information regarding time, a date, a calendar, or the like is displayed) in the simple display mode section may be varied.

For example, a digital clock may be displayed after an analog clock has been displayed.

Figure 16:
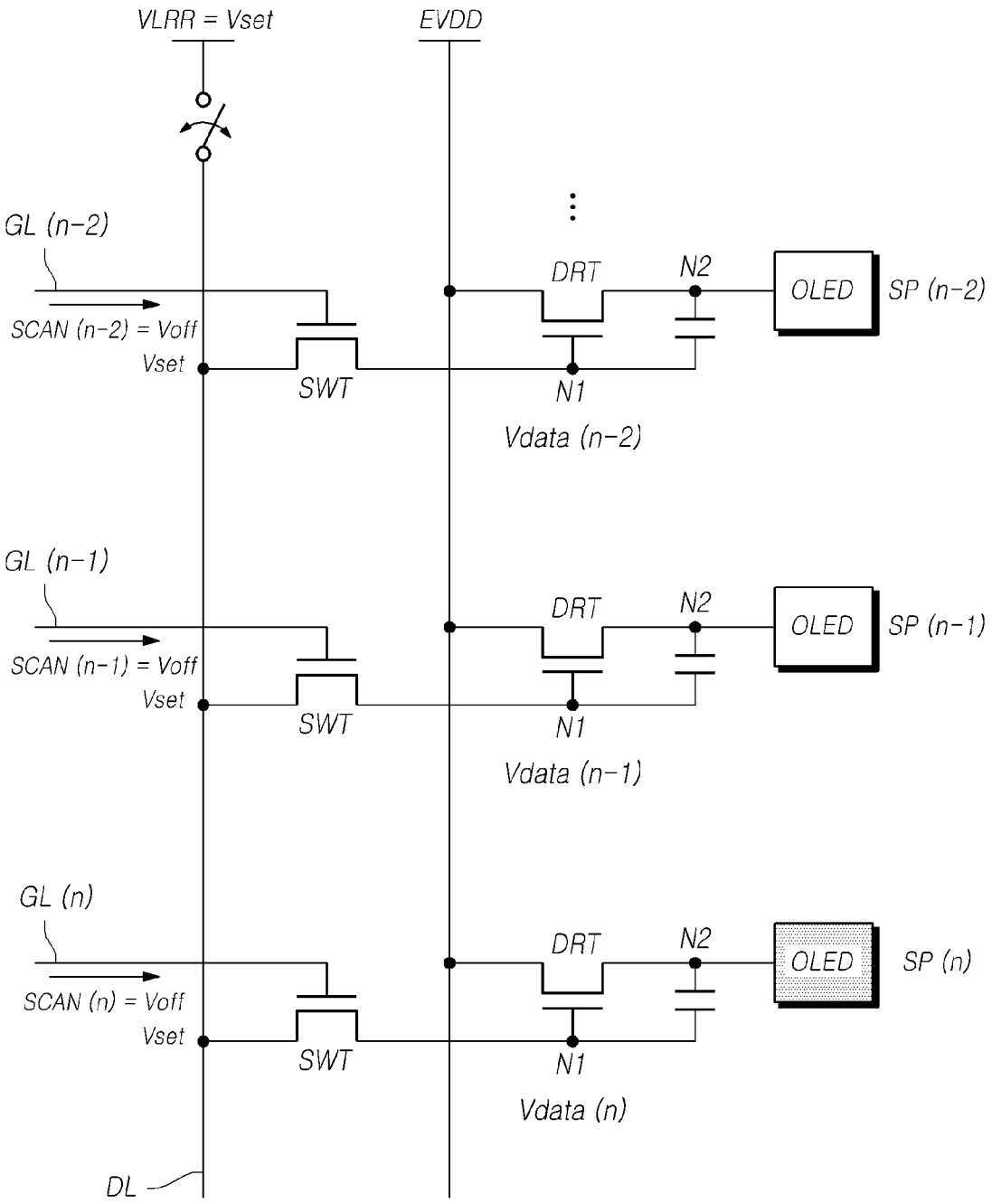
FIG. 16 illustrates another second low power driving method of the organic light-emitting display device according to example embodiments in a simple display mode.

FIG. 16 illustrates another second low power driving method of the organic light-emitting display device 100 according to example embodiments in a simple display mode.

Referring to FIG. 16, in the organic light-emitting display device 100 according to example embodiments, when switching to the simple display mode, the data driver 120 can supply a specific voltage VLRR to the data line DL in a data holding section after data voltages . . . , Vdata(n−2), Vdata(n−1), and Vdata(n) are sequentially supplied to the subpixels . . . , SP(n−2), SP(n−1), and SP(n) connected to the data line DL.

Here, the specific voltage VLRR may be a voltage corresponding to an LRR driving enable voltage supplied to the data line DL in the data holding section, and may not be identical to any data voltage among the data voltages . . . , Vdata(n−2), Vdata(n−1), and Vdata (n) sequentially supplied to the subpixels . . . , SP(n−2), SP(n−1), and SP(n) connected to the data line DL.

Referring to FIG. 16, the specific voltage VLRR may be a randomly set voltage Vset to effectively prevent flickering by effectively preventing the leakage current.

Here, the set voltage Vset may be an approximate voltage that differs by a predetermined voltage value from one data voltage among the data voltages . . . , Vdata(n−2), Vdata (n−1), and Vdata(n) sequentially supplied to the subpixels . . . , SP(n−2), SP(n−1), and SP(n) connected to the data line DL.

For example, the set voltage Vset may have an approximate voltage value differing by a predetermined voltage value from that of one data voltage among the data voltages . . . , Vdata(n−2), Vdata(n−1), and Vdata(n) sequentially supplied to the subpixels . . . , SP(n−2), SP(n−1), and SP(n) connected to the data line DL.

In addition, the set voltage Vset, which may be a specific voltage VLRR, may be a fixed value that is constant during all driving or may be a variable value that is variously set in each driving, in specific circumstances, or for predetermined periods.

As described above, the second low power driving method uses the set voltage Vset as the specific voltage VLRR corresponding to the LRR driving enable voltage instead of selecting one data voltage among the data voltages . . . , Vdata(n−2), Vdata(n−1), and Vdata(n) sequentially supplied to the subpixels . . . , SP(n−2), SP(n−1), and SP(n) connected to the data line DL. It is thereby possible to effectively prevent the leakage current Ioff from being generated in the switching transistor SWT and effectively prevent resultant flickering by considering the characteristics of data voltages supplied to the subpixels or the circuit characteristics or the panel characteristics of the switching transistor SWT or the like.

As set forth above, according to example embodiments, the organic light-emitting display panel 110, the organic light-emitting display device 100, the data driver 120, and the low power driving method can effectively realize a simple display mode in which necessary information can be displayed for user convenience.

According to example embodiments, the organic light-emitting display panel 110, the organic light-emitting display device 100, the data driver 120, and the low power driving method can simply realize a simple display mode at a low level of power.

In addition, according to example embodiments, the organic light-emitting display panel 110, the organic light-emitting display device 100, the data driver 120, and the low power driving method can realize a simple display mode at a low level of power and effectively prevent the leakage current from being generated in the switching transistors SWT in the subpixels, thereby effectively reducing flickering in a simple display mode section.

The foregoing descriptions and the accompanying drawings have been presented in order to explain the certain principles of the present disclosure. A person skilled in the art to which the disclosure relates could make many modifications and variations by combining, dividing, substituting for, or changing the elements without departing from the principle of the disclosure. The foregoing embodiments disclosed herein shall be interpreted as illustrative only but not as limitative of the principle and scope of the disclosure. It should be understood that the scope of the disclosure shall be defined by the appended Claims and all of their equivalents fall within the scope of the disclosure.

What is claimed is:

1. An organic light-emitting display device comprising:

an organic light-emitting display panel having a plurality of subpixels connected to data lines and gate lines;

a data driver configured to drive the data lines; and a gate driver configured to drive the gate lines, wherein the organic light-emitting display device has a first mode having a first refresh rate and a second mode having a second refresh rate that is lower than the first refresh rate, the second mode having a first period and a second period that is subsequent to the first period, and wherein, in the first period of the second mode, the data driver sequentially supplies data voltages to at least two of the plurality of subpixels, and in the second period of the second mode, the data driver supplies a specific voltage to both of the at least two of the plurality of subpixels to which the data voltages were supplied in the first period of the second mode, the specific voltage being variable based on one of at least two of the data voltages sequentially supplied to the at least two subpixels.

2. The organic light emitting display device of claim 1, wherein the second period of the second mode is a data holding period.

3. The organic light emitting display device of claim 1, wherein the specific voltage is based on the highest voltage among the at least two of the data voltages sequentially supplied to the at least two subpixels in the first period of the second mode.

4. The organic light emitting display device of claim 1, wherein the at least two subpixels have at least one of a first luminance and a second luminance in the second mode, and the first luminance is higher than the second luminance.

5. The organic light-emitting display device of claim 1, wherein, while the data driver is supplying the specific voltage to the data lines, the gate driver supplies scanning signals of turn-off level voltages to the gate lines corresponding to the at least two subpixels in the second period of the second mode.

6. The organic light-emitting display device of claim 1, wherein, when the specific voltage is supplied to the data lines, a leakage current is not generated in a switching transistor of at least one subpixel among the at least two subpixels supplied with the specific voltage.

7. The organic light-emitting display device of claim 1, wherein the specific voltage is the same as one of the at least two of the data voltages sequentially supplied to the at least two subpixels in the first period of the second mode.

8. The organic light-emitting display device of claim 1, wherein the specific voltage is the same as the one data voltage that is supplied to the last of the at least two subpixels.

9. The organic light-emitting display device of claim 1, wherein the organic light-emitting display panel displays images or text with at most a specific number of colors in a section of the second mode than the first mode.

10. The organic light emitting display device of claim 1, wherein the specific voltage differs by a predetermined voltage value from the one of at least two of the data voltages sequentially supplied to the at least two subpixels in the first period of the second mode.

11. A driving method for an organic light-emitting display device using a first mode having a first refresh rate and a second mode having a second refresh rate that is lower than the first refresh rate, the second mode having a first period and a second period that is subsequent to the first period, the method comprising:

sequentially supplying data voltages to at least two of a plurality of subpixels that are connected to data lines and gate lines in the first period of the second mode; and supplying a specific voltage to both of the at least two of the plurality of subpixels to which the data voltages were supplied in the first period of the second mode, in the second period of the second mode, the specific voltage being variable based one of at least two of the data voltages sequentially supplied to the at least two subpixels.

12. The method of claim 11, wherein the second period of the second mode is a data holding period.

13. The method of claim 12, wherein the specific voltage is based on the highest voltage among the at least two of the data voltages supplied to the at least two subpixels.

14. The method of claim 12, wherein the at least two subpixels have at least one of a first luminance and a second luminance in the second mode, and the first luminance is higher than the second luminance.

15. The method of claim 11, wherein, while the specific voltage is supplied to the data lines, the gate driver supplies scanning signals of turn-off level voltages to the gate lines corresponding to the at least two subpixels in the second period of the second mode.

16. The method of claim 11, wherein, when the specific voltage is supplied to the data lines, a leakage current is not generated in a switching transistor of at least one subpixel among the at least two subpixels supplied with the specific voltage.

17. The method of claim 11, wherein the specific voltage is the same as one of the at least two of the data voltages sequentially supplied to the at least two subpixels.

18. The method of claim 11, wherein the specific voltage is the same as the one data voltage that is supplied to the last of the at least two subpixels.

19. The method of claim 11, wherein the organic light-emitting display panel displays images or text with at most a specific number of colors in a section of the second mode than the first mode.

20. The method of claim 11, wherein the specific voltage differs by a predetermined voltage value from the one of at least two of the data voltages sequentially supplied to the at least two subpixels in the first period of the second mode.

* * * * *